United States Patent [19]

Okada

[11] 4,034,817

[45] July 12, 1977

[54] IMPACT TOOL

[75] Inventor: Hiroshi Okada, Suita, Japan

[73] Assignee: Nippon Pneumatic Manufacturing Co., Ltd., Osaka, Japan

[21] Appl. No.: 650,027

[22] Filed: Jan. 19, 1976

[30] Foreign Application Priority Data

Mar. 18, 1975 Japan ..... 50-34774

[51] Int. Cl.[2] ..... B25D 9/00

[52] U.S. Cl. ..... 173/134; 91/300; 173/116

[58] Field of Search ..... 173/116, 122, 134; 92/134; 91/300

[56] References Cited

U.S. PATENT DOCUMENTS

| | | | |
|---|---|---|---|
| 914,602 | 3/1909 | Polzer | 91/300 |
| 3,035,548 | 5/1962 | Wittlich | 173/134 |
| 3,713,367 | 1/1973 | Butterworth | 91/300 |
| 3,741,316 | 6/1973 | Alajouanine | 173/116 |
| 3,774,502 | 11/1973 | Arndt | 91/300 |

*Primary Examiner*—Robert A. Hafer
*Attorney, Agent, or Firm*—Wenderoth, Lind & Ponack

[57] ABSTRACT

An impact tool. A piston movable in a cylinder is pushed up by hydraulic pressure, compressing a gas in a chamber over the piston. The compressed gas drives down the piston by its repulsive force to strike a tool such as a chisel. A valve body in a valve chest in a valve box attached to the cylinder is also reciprocated up and down by hydraulic pressure to communicate an oil supply port for hydraulic pressure to act on alternately the piston and the valve body.

1 Claim, 2 Drawing Figures

IMPACT TOOL

BRIEF SUMMARY OF THE INVENTION

The present invention relates to an impact tool adapted to reciprocate a piston by means of hydraulic pressure and compressed gas to strike a tool such as a chisel.

The present invention consists in an impact tool which has a piston pushed up by hydraulic pressure to compress a gas, such as air or nitrogen, in a chamber over the piston, the compressed gas driving the piston down.

An object of this invention is to provide an impact tool which has a larger impact force resulting from rapid action given by the use of compressed gas.

Another object of this invention is to provide an impact tool which consumes only a minimum amount of gas to compensate for slight leakage from the seal.

A further object of this invention is to provide an impact tool which eliminates compressing means which was required on conventional pneumatic tools of this type.

Other objects and advantages of the present invention will become apparent from the following description with reference to the accompanying drawings.

DETAILED DESCRIPTION

Figure 1:
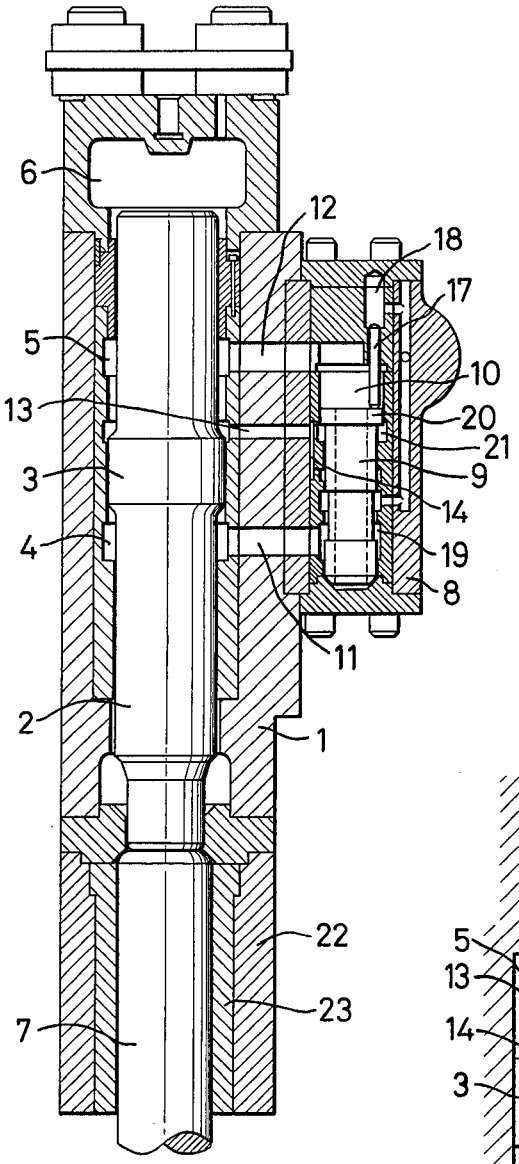
FIG. 1 is a vertical sectional view of a preferred embodiment of the present invention.
Figure 2:
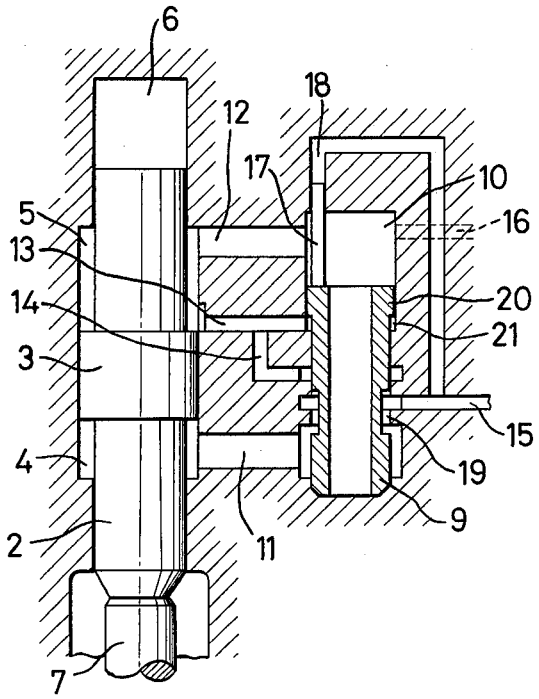
FIG. 2 is an explanatory diagram showing how the preferred embodiment operates.

Referring to the drawings, the lefthand and righthand sides of which correspond to the top and bottom of the impact tool, respectively. In a cylinder, a piston 2 is reciprocably fitted and has an integral larger diameter portion 3 intermediately of its length. A suitable bush is fixedly interposed therebetween to form a lower chamber 4 under the larger diameter portion 3 and a middle chamber 5 thereover. An upper chamber 6 is also formed over the piston 2.

Under the cylinder 1 is disposed a chisel holder 22 in which a chisel 7 is movably mounted with the interposition of a bush 23 so as to be struck on its top end by the piston 2 when the latter is lowered.

On one side of the cylinder 1, a valve box 8 is secured in which a bush is fixedly mounted and defines a valve chest 10 wherein a valve body 9 having a flange at its upper end is reciprocally mounted.

The lower chamber 4 communicates with the lower portion of the valve chest 10 through a passage 11. The upper portion of the valve chest 10 communicates with the upper portion of the middle chamber 5 through a passage 12. A passage 13 communicates the lower portion of the middle chamber 5 with a valve chest 21 defined under the flange 20 so long as the connection is not blocked by the piston 2. A passage 14 branching from the passage 13 leads to a peripheral groove cut in the inner periphery of the valve chest 10.

An oil supply port 15 disposed at a level between the passages 11 and 14 is connected to a hydraulic pump. An oil discharge port 16 communicates with the upper portion of the valve chest 10. A rod 17 is vertically movably fitted in a vertical hole 18 in the valve box 8, said hole communicating with the oil supply port 15.

The valve body 9 is a tubular member open at both ends thereof and formed with the flange 20 at its upper end and a peripheral groove 19 in the outer periphery thereof and intermediately of its length. The flange 20 is fitted in the upper larger diameter portion of the valve chest 10. The underside of the flange 20 has a larger area than the top surface of the rod 17.

The passage 14 is narrower than the passage 13. In the inner periphery of the valve chest 10 are peripheral grooves which communicate with the oil supply port 15 and the passages 11, 13 and 14, respectively. The outer peripheral groove 19 in the valve body 9 is of a sufficient width to communicate the oil supply port 15 alternately with the passages 11 and 14 as the valve body 9 moves up and down.

A bomb of compressed air or gas (not shown) is connected to the upper chamber 6 to keep it at a predetermined pressure when the piston 2 is in its lowermost position. Between the upper chamber 6 and the bomb is a pressure reducing valve or a check valve to keep the gas from escaping from the upper chamber 6 when the piston 2 is pushed up.

In the drawings, both the piston 2 and the valve body 9 are in their lowermost position when the valve body 9 is closed with its lower end butting against the bottom of the valve chest 10. When hydraulic oil under a predetermined pressure is supplied from the oil supply port 15, it flows through the peripheral groove 19 and the passage 11 to the lower chamber 4 where it acts on the underside of the larger diameter portion 3 of the piston 2 to urge it upward.

As the piston 2 goes up compressing the gas in the upper chamber 6, the oil in the middle chamber 5 is expelled to the oil discharge port 16 through the passage 12 and the upper portion of the valve chest 10. Part of the hydraulic oil from the oil supply port 15 flows into the vertical hole 18 to push down the rod 17, which in turn pushes the valve body 9 down against the bottom of the valve chest 10.

When the piston 2 goes up until the lower end of the larger diameter portion 3 comes above the passage 13, the lower chamber 4 communicates with the passage 13 so that hydraulic pressure acts on the underside of the flange 20 on the valve body 9.

Because the underside of the flange 20 has a larger area than the top surface of the rod 17, the valve body 9 is pushed up off the bottom of the valve chest 10 against the hydraulic presssure applied to the rod 17. Accordingly, the passage 11 communicates with the opening through the valve body 9 and is then shut off from the oil supply port 15. This allows the oil in the lower chamber 4 to flow through the passage 11 and the valve body 9 to the oil discharge port 16 and the passage 12.

As a result, the compressed gas within the upper chamber 6 drives down the piston 2 violently to strike the chisel 7. Also, when the valve body 9 goes up, the oil supply port 15 communicates with the passage 14 through the peripheral groove 19 so that oil pressure acts on the underside of the flange 20 because the passage 13 is now blocked. Therefore, it continues to go up so long as the larger diameter portion 3 shuts off the passage 13. This causes oil to flow out of the lower chamber 4 more easily.

When the piston 2 is lowered to such a position that the larger diameter portion 3 is below the passage 13, the latter communicates again with the middle chamber 5 which is connected through the passage 12 to the oil discharge port 16. If the passage 14 had a cross-sectional area equal to that of the passage 12, hydraulic pressure acting on the rod 17 would be equal to that acting on the valve body 9 so that the rod 17 could not press down the valve body 9. Since in this invention the passage 14 is narrower than the passage 12, the hydraulic pressure on the rod 17 is high enough to cause it to press down the valve body 9 back to its original position. So long as hydraulic oil under pressure is supplied from the oil supply port 15, the above-mentioned process is repeated to reciprocate the piston 2 up and down, striking the chisel 7 repeatedly.

Since during the downward stroke of the piston the oil in the lower chamber 4 finds its way through the passage 11, the lower portion of valve chest 10, the valve body 9, the upper portion of valve chest 10 and the passage 12 to the middle chamber 5 as well as the oil discharge port 16, the piston 2 is driven down at a sufficiently high speed even if there exists any resistance to the flow toward the oil discharge port 16.

Another advantage is very simple construction in which a single valve body 9 is used to change over the hydraulic circuit for the piston 2.

While the present invention has been shown and described with reference to a preferred embodiment, it will be understood by those skilled in the art that other changes in form and details can be made therein without departing from the spirit and scope of the invention.

What is claimed is:

An impact tool to be connected to a fluid source comprising:

a hollow cylinder having a closed upper end;

a tool holder secured to the lower end of said hollow cylinder;

a chisel movably mounted in said tool holder;

piston means reciprocally mounted in said hollow cylinder above said chisel for striking said chisel when said piston means moves downward, said piston means forming an upper chamber above itself within said hollow cylinder, and said piston means further having a larger diameter portion intermediately of its length, said larger diameter portion forming a lower chamber therebeneath and a middle chamber thereabove;

constant pressure means connected to the top of said hollow cylinder for supplying a constant pressure in said cylinder above said piston means;

a valve box attached to said hollow cylinder and having a fluid supply port thereinto and a fluid discharge port therefrom, said valve box further having a hollow valve chest therein connected at the lower portion thereof to said supply port and at the top portion thereof to said discharge port, said valve chest also being connected by first, second and third openings respectively to said lower, middle and upper chambers formed when said piston means is in its lowermost position;

a valve body having a longitudinal opening therethrough slidably mounted in said valve chest, said valve body having an outwardly extending flange surrounding the upper end thereof, said valve body in said hollow valve chest communicating fluid from said supply port through said valve chest into said lower chamber through said first opening when said valve body is in its lowermost position in said hollow valve chest, whereby fluid from said supply port can flow into said lower chamber and force upward against said piston means, and said opening through said valve body communicates said lower chamber with said discharge port when said valve body is in its uppermost position, whereby fluid can be expelled from beneath said piston means through said first opening into said valve chest and out said discharge opening;

rod means of smaller diameter than said valve body mounted within said valve box above said valve body and operatively connected to said supply port for forcing downward against said valve body due to the pressure of the fluid from said supply port;

said third opening connecting said upper chamber to said valve chest above said valve body therein; and said second opening connecting said middle chamber above said larger diameter portion of said piston means having two branches connected into said valve chest beneath said flange on said valve body when said valve body is in its lowermost position.

* * * * *